US006125719A

United States Patent [19]

Lowther et al.

[11] Patent Number: 6,125,719

[45] Date of Patent: Oct. 3, 2000

[54] SLIDE HAMMER

[75] Inventors: John K. Lowther, Denver; Kenneth W. Welden, Littleton, both of Colo.

[73] Assignee: Slide Sledge Technology, Inc., Denver, Colo.

[21] Appl. No.: 09/281,007

[22] Filed: Mar. 30, 1999

[51] Int. Cl.[7] ..... B25D 1/00

[52] U.S. Cl. ..... 81/27; 173/90

[58] Field of Search ..... 81/27; 173/90, 173/91

[56] References Cited

U.S. PATENT DOCUMENTS

| | | | |
|---|---|---|---|
| 839,246 | 12/1906 | Williams | 173/90 |
| 2,475,041 | 7/1949 | Mattson | 173/132 |
| 4,241,795 | 12/1980 | Landry, Jr. | 173/90 |
| 4,470,440 | 9/1984 | Thor | 144/193 |
| 5,085,281 | 2/1992 | Selly | 173/91 |
| 5,370,192 | 12/1994 | Evinger | 173/90 |

OTHER PUBLICATIONS

John K. Lowther, "Explanation of Applicant's Prior Art", Jul. 1, 1999, pp. 1,2 (with photographs).

*Primary Examiner*—David A. Scherbel
*Assistant Examiner*—Hadi Shakeri
*Attorney, Agent, or Firm*—Fields and Johnson, P.C.

[57] ABSTRACT

A slide hammer includes three major components, namely, a guide sleeve, a plunger and an impact head. The plunger is inserted within the guide sleeve. The impact head is secured within the distal end of the guide sleeve, and has a portion which protrudes from the guide sleeve distal end. The impact head is able to freely slide within a segmented portion of the guide sleeve distal end. The plunger is slid within the guide sleeve at a selected velocity in order to contact the portion of the impact head slidably secured within the guide sleeve. The force of the plunger striking the impact head is transmitted through the impact head to a targeted object in contact with the protruding portion of the impact head. The impact head may be fitted with various types of tips.

17 Claims, 4 Drawing Sheets

SLIDE HAMMER

TECHNICAL FIELD

This invention relates to a device which transfers the force of an impact to a targeted object and, more particularly, to a slide hammer which transfers the force of an impact to a targeted object.

BACKGROUND ART

It is known to use various combinations of chisels and hammers in order to impart a force upon a targeted object. In the automotive repair industry, it is often necessary to reshape and straighten vehicle body frames which have been damaged. Various forms of frame straightening machines are available for such purposes. However, even with the availability of such machines, it is still necessary in most cases to apply manual force to the frame in order to achieve the exact type of reshaping necessary to straighten the frame. Particularly for hard-to-reach locations on the vehicle frame, pneumatic or hydraulic machines are simply not able to be positioned in a manner to provide force against the targeted frame location. Also, for intricate reshaping of smaller frame members, machines are unsuitable. Thus, the straightening of a vehicle body frame still requires a considerable amount of manual labor.

One disadvantage of using a hammer and chisel is that the hammer and chisel have to be firmly gripped. Because metal to metal contact is made between the frame and the chisel, most of the force of the impact is transmitted back through the user's hands and arms. This force transmitted back through the hands and arms of a person can cause great pain and discomfort, as well as to cause premature fatigue. Because the hammer has to be swung with great force, the hammer itself can become a danger, particularly in hammering out those hard-to-reach locations on the frame. These and other known hazards make the use of a chisel and hammer undesirable.

Therefore, a need exists for a device which can be safely and easily manipulated by a user for applying a desired amount of force to a targeted object. A need also exists for a hammering device which allows a user to vary the amount of force applied by the device without having to substantially change the user's physical efforts in manipulating the device.

It is one object of this invention to provide a slide hammer device which is able to transfer the force of an impact to a specific targeted object. It is another object of this invention to provide a slide hammer device which minimizes the reaction force which is transmitted back through the user's hands and arms. It is yet another object of this invention to provide increased safety with a hammering device. It is yet another object of this invention to provide a hammering device which has removable and varying tip configurations in order to further control the type of force applied to the targeted object. These objects and others will be explained more fully below as they apply to the slide hammer device of this invention.

DISCLOSURE OF THE INVENTION

In its simplest form, the slide hammer of this invention is a hammering device which allows the force of an impact to be transferred to a targeted object. The apparatus has three major components, namely, a guide sleeve, a plunger, and an impact head. The plunger is inserted within the guide sleeve. The impact head is secured within the distal end of the guide sleeve, and has a portion which protrudes from the guide sleeve distal end. The impact head is able to freely slide within a specified portion of the guide sleeve distal end. The plunger is slid within the guide sleeve and is able to make contact with the portion of the impact head slidably secured within the guide sleeve. The force of the plunger moving striking the impact head is transmitted through the impact head to a targeted object contacted by the impact head, such as a vehicle frame member. The impact head may be fitted with various types of tips. The particular tip chosen is based upon the type of force which is to be applied upon the targeted object. The exterior dimension of the plunger and the channel or opening in the guide sleeve are sized for a relatively close tolerance fit which ensures a smooth sliding movement of the plunger within the guide sleeve. The portion of the impact head secured within the guide sleeve distal end is also sized so that it maintains a relatively precise sliding movement within the guide sleeve. Optionally, various sized weights may be added to the plunger in order to increase or decrease the amount of force which is transmitted from the plunger to the impact head. A removable handle may be mounted to the guide sleeve in order to further reduce the shock of the impact which is transmitted back through the user's hands and arms, and also to allow the device to be more easily gripped during use. Also, a removable support may be used when the device is used to apply force to an object on the ground, such as concrete or asphalt.

The use of the guide sleeve to guide the plunger greatly increases the accuracy at which a force is applied and to a targeted object. Not only can the angle at which the force is applied be better controlled, but also the magnitude of the applied force as well. The guide sleeve acts as an alignment means for directing the force at a desired angle. Since the plunger travels along this aligned path, the angle at which the force is applied to a targeted object is very accurate. With a hammer and chisel, it is much more difficult to maintain this aligned path between the chisel axis and the angle at which the hammer strikes the chisel head; therefore, the angle at which force is applied to a targeted object is more inconsistent. In terms of force magnitude, the plunger may be slid within the guide sleeve at the appropriate velocity to increase or decrease the force transmitted through the impact head. The use of the guide sleeve in conjunction with the plunger also makes the application of force safer since there is no possibility that the plunger will become disengaged from or otherwise slip away from the impact head during impact. Since the plunger may be slid within the guide sleeve as opposed to being independently lifted or carried throughout a striking motion, the user must only overcome the slight friction between the guide sleeve and the plunger to move the plunger for contact with the impact head. The plunger may be lubricated as necessary to further reduce the amount of effort required to slide the plunger within the guide sleeve. The removable weights attached to the plunger can allow one to further vary the force applied. Additionally, the guide sleeve and plunger may be made longer or shorter depending upon the application and the amount of force to be applied to the targeted object. Because the impact head may be fitted with removable tips, the slide hammer is adaptable for use in many applications.

The use of the device results in less force being transmitted back through the hands and arms of a user. When the plunger achieves the desired velocity within the guide sleeve, the user's hand need not be gripped tightly around the proximal end of the plunger which, in turn, reduces the amount of force transmitted back through that hand. As discussed above with respect to a standard hammer and chisel, a hammer must always be tightly gripped during impact against the chisel which, in turn, results in much greater force being transmitted back through the hand. Also, since the impact head is able to slide along a specified length within the guide sleeve, the guide sleeve itself may recoil and absorb the retransmitted impact force which further reduces the shock experienced by the user's hand which grips the guide sleeve. In general, the sliding engagement of the impact head and the plunger within the guide sleeve combines to enhance the shock absorption characteristics of the slide hammer.

Since the impact head is able to slide with minimal resistance within the specified portion of the guide sleeve, the full impact of the moving plunger may be transmitted to the impact head which, in turn, helps to ensure that an adequate force is applied to the targeted object.

These and other advantages will become more apparent by a review of the following figures, in conjunction with the detailed description.

BEST MODE FOR CARRYING OUT THE INVENTION

Figures 1, 2, 3:
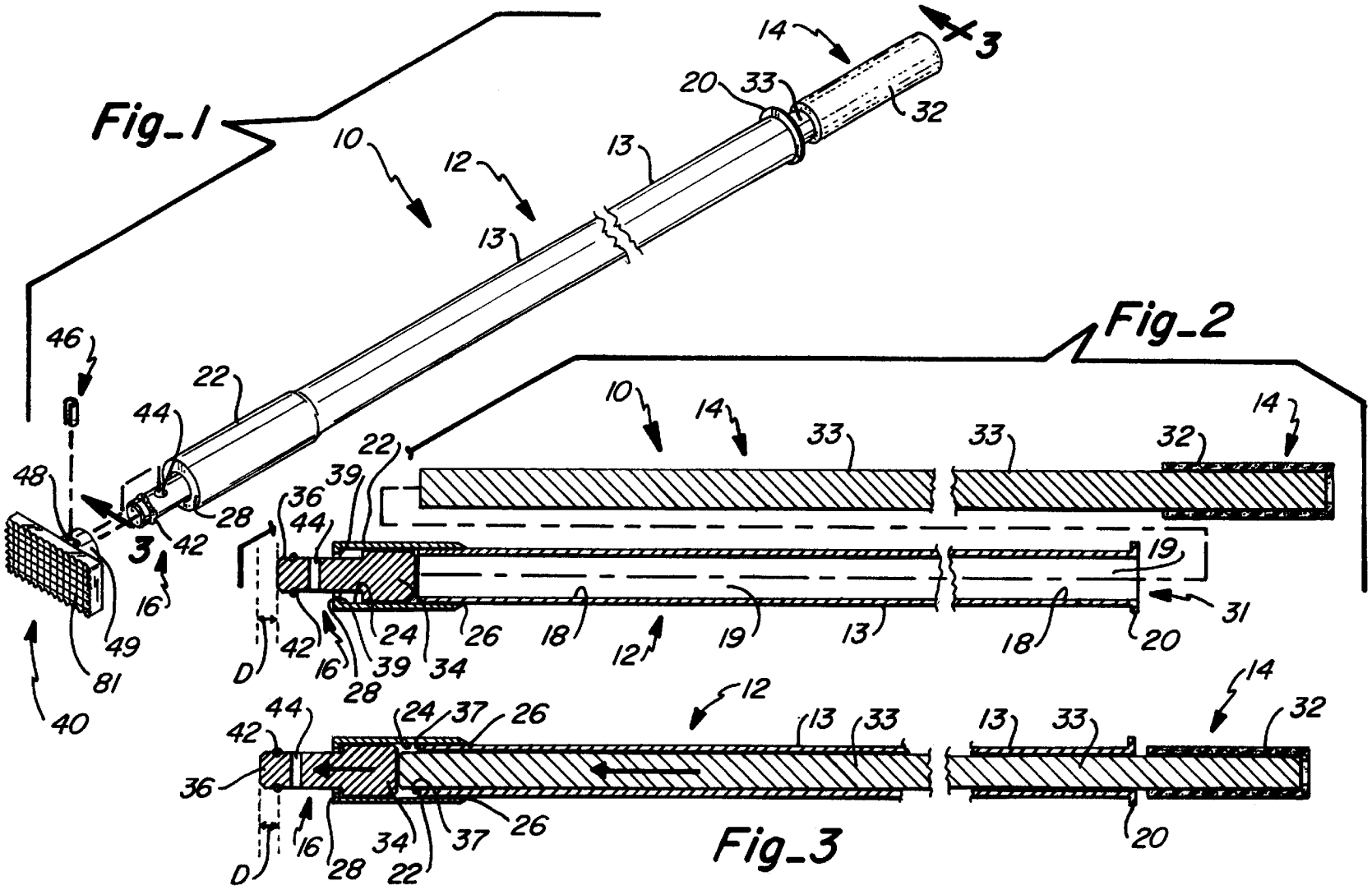
FIG. 1 is a partially exploded perspective view of the slide hammer of this invention.
FIG. 2 is a partially exploded vertical section, taken along line 3—3 of FIG. 1.
FIG. 3 is a vertical section, taken along line 3—3 of FIG. 1.

As shown in FIGS. 1–3, the slide hammer 10 includes three major components, namely, a guide sleeve 12, a plunger 14 that is slidably engaged within said guide sleeve, and an impact head 16 which is slidably secured within the distal end of the guide sleeve 12. The guide sleeve 12 is preferably of a cylindrical shape, and has a main guide sleeve section 13 and a corresponding inner cylindrical surface 18 forming a longitudinal passageway 19. A flange 20 is formed at the proximal end of the guide sleeve. The guide sleeve 12 further includes an impact head receiving section 22. As shown in the vertical sections of FIGS. 2 and 3, receiving section 22 has an inner cylindrical surface 24 which is of a slightly larger diameter than inner surface 18. Receiving section 22 may simply be a larger sized cylinder pipe member which overlaps with main guide sleeve section 13 at welded joint or overlap area 26. The distal end of head receiving section 22 has a washer or distal stop 28 welded thereto.

Plunger 14 is a solid and cylindrical shaped member including a main shaft or rod 33. A gripping means or handle 32 may be attached to the proximal end of plunger 14. The distal end of plunger 14 is inserted within the opening 31 and into passageway 19 of guide sleeve 12. Plunger 14 is slidable within passageway 19 of guide sleeve 12 to make contact with impact head 16. The extent to which plunger 14 is inserted within passageway 19 of guide sleeve 12 may be limited by contact of the handle 32 against flange 20. The distal end of plunger 14 must be able to be inserted far enough within guide sleeve 12 to make contact with impact head 16. As also shown in FIGS. 1–3, impact head 16 includes a slide portion 34 which is slidable within guide sleeve 12 along inner surface 24, and an impact extension 36 which protrudes through washer/stop 28. Impact head 16 may simply be a solid member having two distinct cylindrical sections of differing diameters, namely, impact extension 36 being smaller and slide portion 34 being larger. As shown in FIGS. 2 and 3, impact head 16 is free to slide along inner surface 24 and in the open space between the distal end 37 of main section 13, and the inner surface 39 of washer/stop 28. Thus the distal end 37 of main section 13 forms a proximal stop to limit the proximal travel of impact head 16 while distal stop 28 limits the distal travel. The amount of displacement or movement within receiving section 22 by impact head 16 is shown as distance D in FIGS. 2 and 3. This distance D may be adjusted as desired by either increasing or decreasing the length of slide portion 34, or by increasing or decreasing the length of head receiving section 22. Additionally, while the preferred embodiment shows the guide sleeve 12 and plunger 14 being of certain relative lengths, it shall also be understood that the lengths of these members may also be increased or decreased as desired.

Depending upon the type of impact or force to be applied to a targeted object, a number of different types of interchangeable tips 40 may be employed. FIG. 1 and FIGS. 7–16 illustrate examples of interchangeable tips 40. Each of the interchangeable tips 40 include a bore or channel 47 formed in a receiving section 49 to receive impact extension 36. Interchangeable tips 40 may be secured to impact section 36 in any number of well-known means. For example, a radial groove may be formed in impact extension 36 and a biased split ring 42 may be secured within the groove. Alternatively, or in conjunction with the use of split ring 42, a hole 44 may be drilled through impact extension 36. A roll or cotter pin 46 may then be used to secure the tip 40. If such a pin 46 is used, a corresponding hole 48 may be drilled in receiving section 49 of the tip 40.

Figure 4:
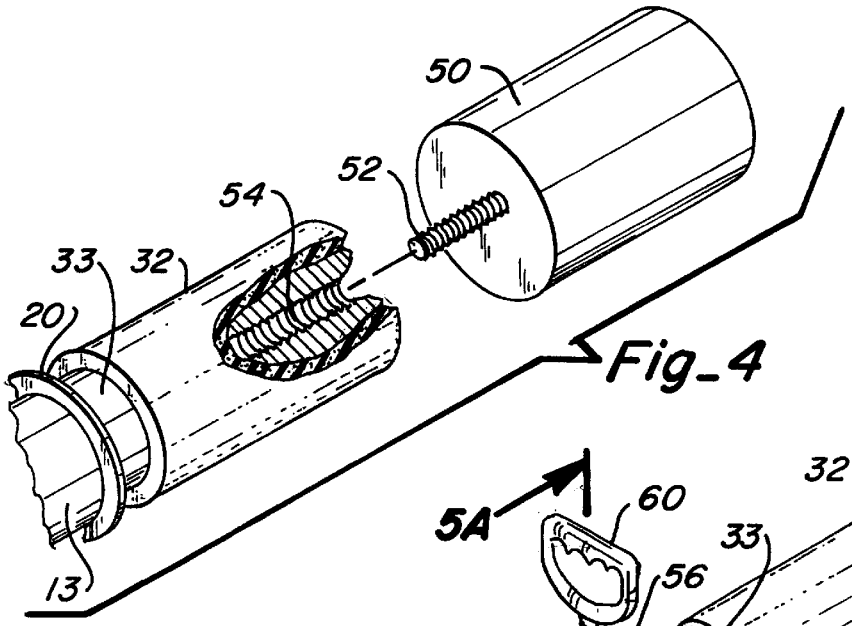
FIG. 4 is an enlarged fragmentary exploded perspective view illustrating a removable weight attached to the proximal end of the plunger.

Now referring to FIG. 4, a weight 50 may removably attach to the proximal end of plunger 14 in order to vary the amount of force which is applied to a targeted object. As shown, weight 50 may simply be another solid, cylindrical member with a protruding threaded screw 52 which is screwed into a corresponding threaded well 54 formed in the proximal end of plunger 14. The specific mass of weight 50 may be adjusted to modify the force to be applied.

Figure 5:
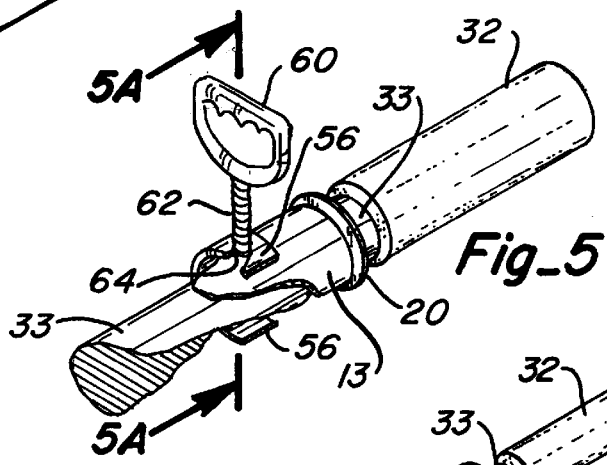
FIG. 5 is a fragmentary perspective view of an integral collar and extending handle which may attach to the guide sleeve to further assist a user in holding the slide hammer during use.
Figure 5A:
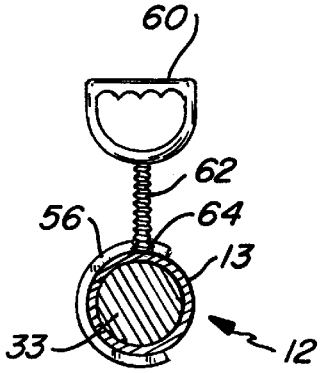
FIG. 5A is a vertical section, taken along line 5A—5A of FIG. 5.

Now referring to FIGS. 5 and 5A, means may be provided on guide sleeve 12 for holding or securing the guide sleeve during use, and further to dampen or reduce the amount of shock that is transmitted to the user. As shown, a collar 56 is placed over the guide sleeve 12, and a handle 60 with a protruding threaded screw or nut 62 is received within a threaded well 64 which extends completely through collar 56. The leading or distal tip of threaded nut 62 contacts the guide sleeve 12 to secure the handle 60 in place. The collar 56 may be placed at any point along the length of the guide sleeve 12.

Figure 6:
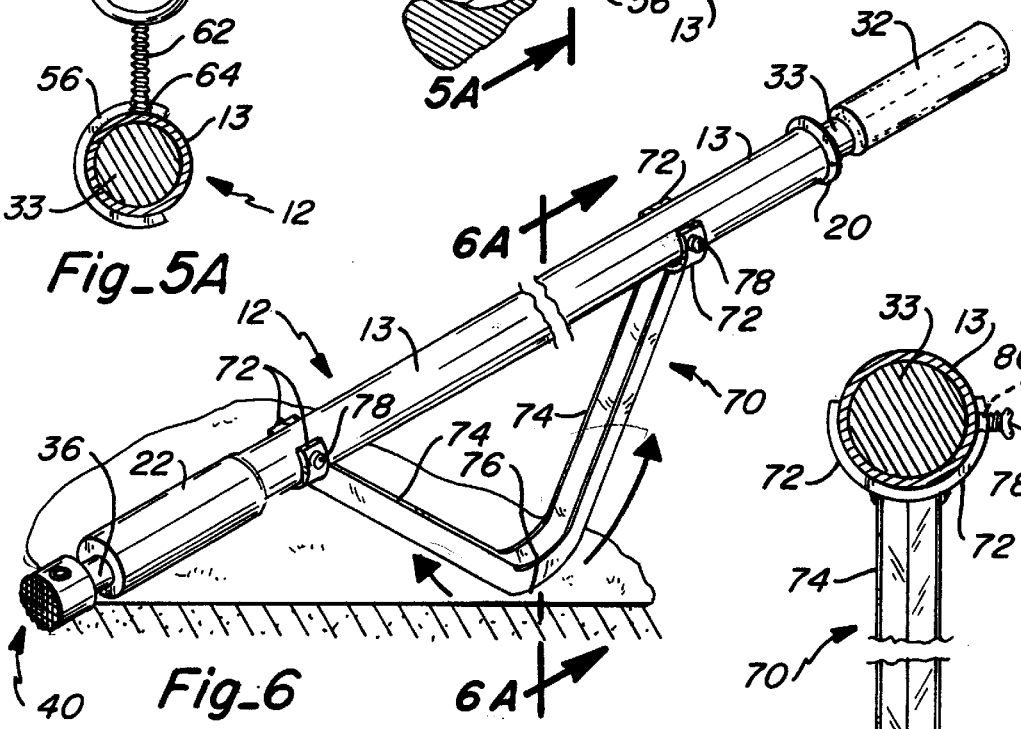
FIG. 6 is a perspective view of the slide hammer and a ground support accessory for supporting the slide hammer when used to contact an object on the surface of the ground.
Figure 6A:
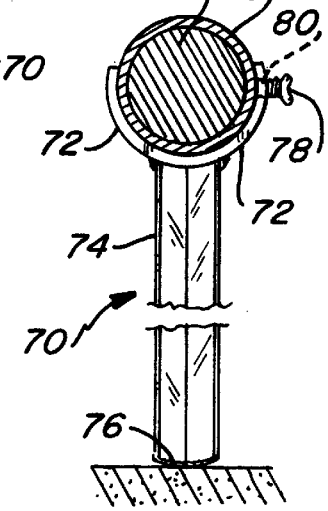
FIG. 6A is an enlarged vertical section, taken along line 6A—6A of FIG. 6.
Figure 7:
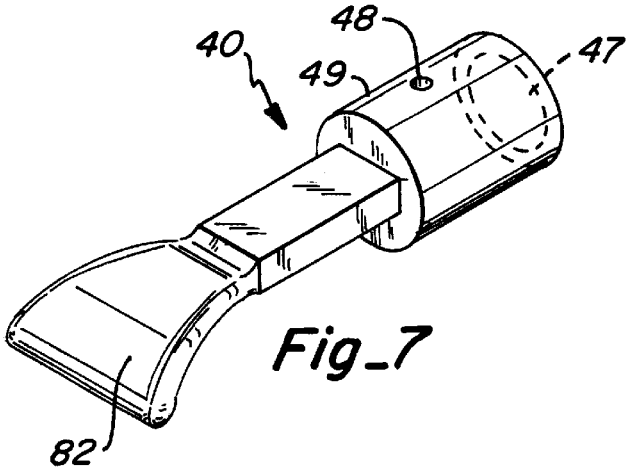
FIGS. 7–16 are enlarged perspective views of the various types of tips which may be used with slide hammer.
Figure 8:
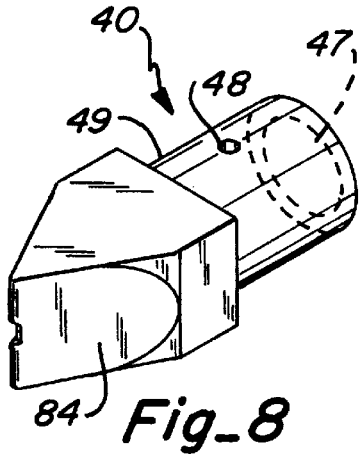
Figure 9:
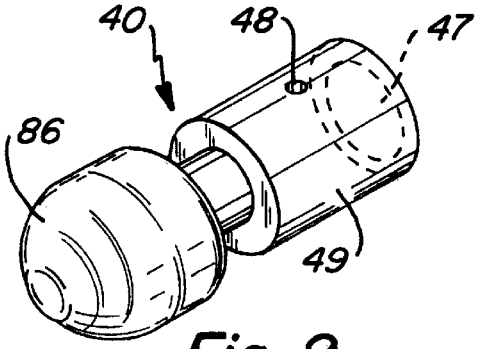
Figure 10:
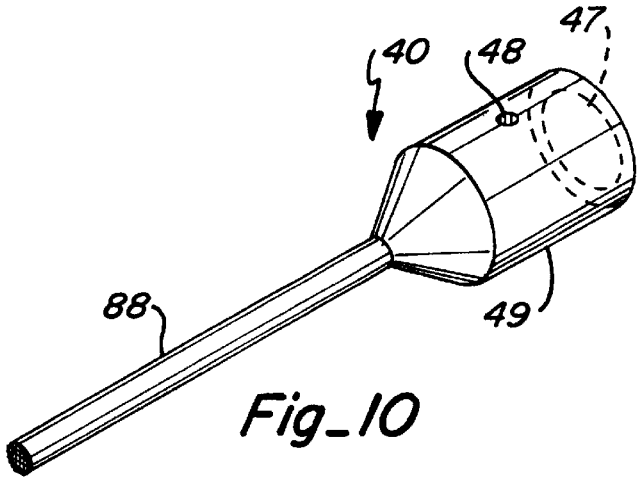
Figure 11:
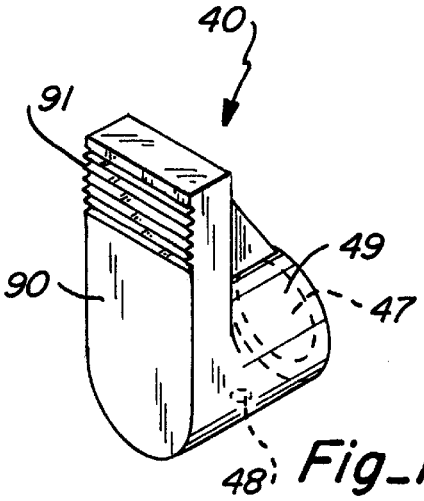
Figure 12:
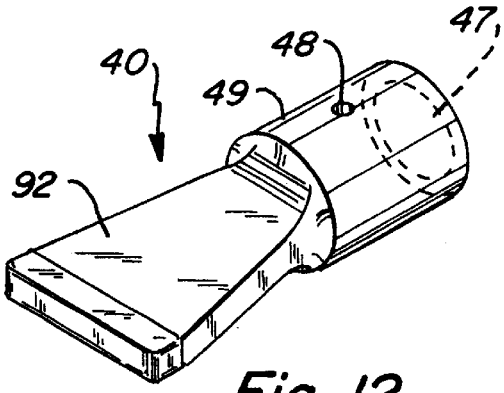
Figure 13:
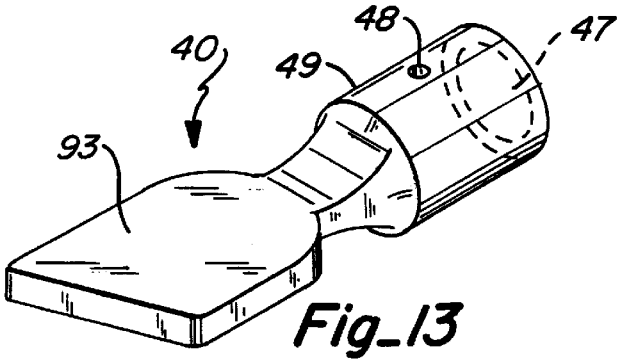
Figure 14:
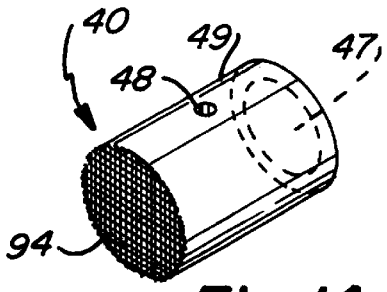
Figure 15:
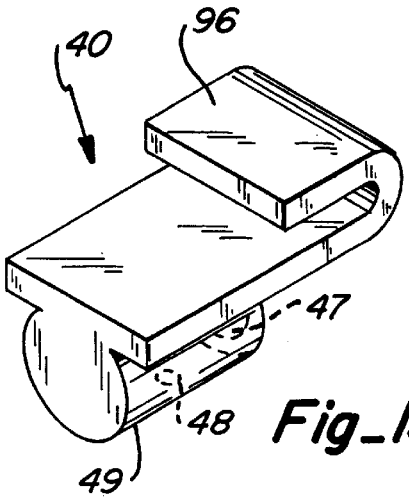

In some applications, it may be necessary to apply a force to an object which is on the surface of the ground. In such applications, it is advantageous to have a support which helps in steadying the guide sleeve 12. Accordingly, FIG. 6 illustrates an accessory in the form of a support 70 which may be used in such circumstances. Support 70 may include a pair of spaced collars 72 interconnected by a curved brace 74. A pivot or contact point 76 is formed approximately midway between collars 72. This pivot/contact point 76 is placed on the ground. Collars 72 may simply be U-shaped members, as shown in FIG. 6A. A tightening nut 78 is received in a threaded well 80 formed in collars 72. The leading or distal tip of tightening nut 78 contacts guide sleeve 12 to secure the brace 70 in place. Although a pair of collars are shown, it shall be understood that only one collar is necessary for support 70. Accordingly, brace 74 could simply be a straight member which extends from collar 72 and has a distal end which contacts the ground;

FIGS. 1 and 7–16 illustrate some examples of the types of tips which may be used with the slide hammer of this invention. As discussed above, common to each of these tips 40 are the corresponding receiving sections 49 with bores or channels 47 for receiving impact extension 36. Each of these tips may also include the holes 48 for receiving the pin 46;

FIG. 1 illustrates a rectangular shaped tip 81 having a waffle-like contacting surface;

FIG. 7 illustrates a curved tip 82;

FIG. 8 illustrates a chisel-type tip 84;

FIG. 9 illustrates a rubber, mallet-type tip 86.;

FIG. 10 illustrates a rod-like tip 88;

FIG. 11 illustrates a blunted tip 90 with grooves 91;

FIG. 12 illustrates a blunted, chisel-type tip 92;

FIG. 13 illustrates a spatula-shaped tip 93;

FIG. 14 illustrates a circular waffle-type tip 94;

FIG. 15 illustrates a hook-type tip 96; and

Figure 16:
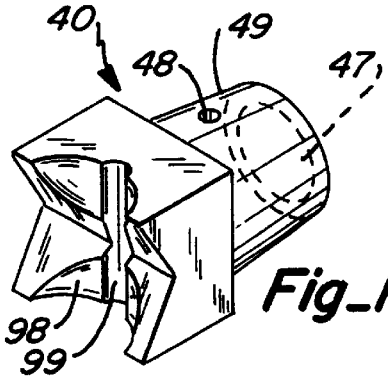

FIG. 16 illustrates a tip 98 which may be used to apply force against a cylinder or rod by placing such cylinder or rod within arcuate groove 99.

Although FIGS. 1 and 7–16 illustrate specific types of tips 40, it shall be understood that other types of tips may be used. These foregoing disclosed tips are similar to tips which may found in commercially available hydraulic ram sets, such as a Port-A-Power™ hydraulic ram sets.

Also, each of the foregoing described tips could be fitted with a ball and socket-type connection (not shown) at receiving sections 49. These rotatable connections would further allow the slide hammer to be positioned in hard-to-reach locations in order to apply a force at an exact desire angle.

In operation, the tip 40 is placed against the targeted object. Preferably, the impact head is placed in the retracted position of FIG. 2, or at least in a partially retracted position. The slide hammer is then positioned at the desired angle with respect to the targeted object. The plunger is then moved at the desire speed within the guide sleeve to contact the impact head. The greater the velocity, the greater the force applied through the impact head to the targeted object. When the force of the impact head is transferred to the targeted object, in accordance with basic physics principles, an equal and opposite reaction will be transmitted back through the impact head. Some of this force will be transmitted back through the guide sleeve, but since the guide sleeve is not rigidly connected to the impact head, a much lesser force will be transmitted through the guide sleeve. Thus, the hand holding the guide sleeve should not experience undue shock. The majority of the recoil or reaction force will be transmitted back through the plunger. Because the user's hand does not need to firmly grasp the plunger, less force will be transmitted back through the user's hand and arm which manipulates the plunger. Additionally, the handle 32 will absorb some of the recoil. In those circumstances when the slide hammer is in use and when the handle 32 is held at a higher elevation than the distal end 30, it may not be necessary to continue to grasp the plunger after its sliding movement within the guide sleeve 12 has reached the desire velocity. Accordingly, no shock or recoil is transmitted through the user's hand or arm. Depending upon the length of the guide sleeve, however, it may be necessary to monitor the recoil of the plunger so it does not completely exit the guide sleeve or otherwise contact the user.

Even if the impact head 16 is in the full extended position of FIG. 3 when the plunger makes contact with the impact head, minimal recoil or reaction forces will be generated through the guide sleeve. Additionally, the vibrations caused by the impact with the targeted object will cause at least some inherent sliding movement of the impact head in the proximal direction which, in turn, will help to dissipate or dampen the recoil. Therefore, regardless of whether the slide hammer is in the fully retracted or extended position, the slide hammer is effective in allowing a force to be projected onto a targeted object without sacrificing safety or comfort for the user.

Figure 17:
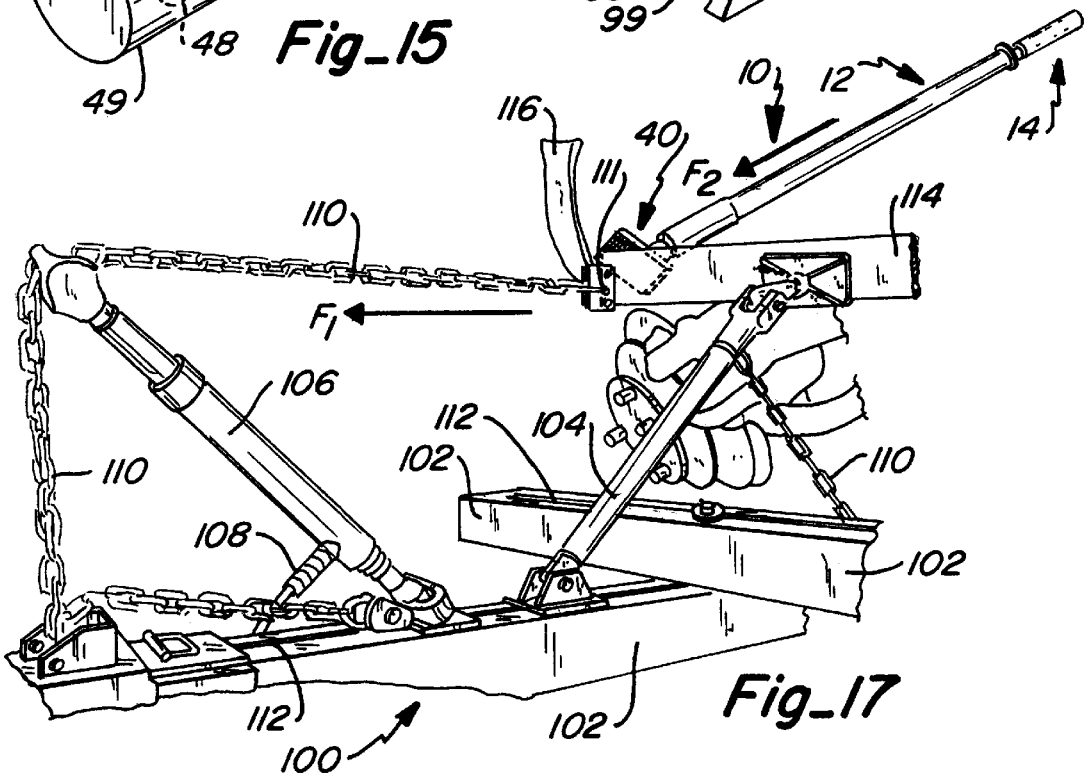
FIG. 17 is a fragmentary perspective view of a vehicle mounted to a frame pulling machine, and the slide hammer of this invention positioned to apply a force against the vehicle frame.

FIG. 17 illustrates how the slide hammer 10 of this invention may be used to apply a force to the portion of the frame of a vehicle near a wheel assembly which must be straightened. As shown, the vehicle may be mounted upon a frame machine or rack 100. Common frame machines 100 include a plurality of beams 102, and braces 104 which may be positioned at the desired points along the vehicle frame. A hydraulic or pneumatic cylinder 106 communicates with a hydraulic or pneumatic pump (not shown) through line 108. A chain 110 is secured between a beam 102 and an attachment point 111 on the vehicle frame. Slots or grooves 112 in beams 102 allow the braces 104 and the cylinders 106 to be positioned as desired. In the particular example of FIG. 17, cylinder 106 is extended which results in a force applied by chain 110 in force direction $F_1$. This results in a force being placed upon longitudinal frame member 114. A vertically extending and curved frame member 116, which is welded to longitudinal frame member 114 at attachment point 111, is also placed under stress by chain 110. The slide hammer 10 may then be used to apply the necessary force to bend frame members 114 and 116. As shown, slide hammer 10 is simply placed on the opposite side of attachment point 111 and a force $F_2$ is applied by striking the plunger 14 against impact head 16.

This invention has been described in detail with reference to a particular embodiment thereof, but it will be understood that various other modifications can be effected within the spirit and scope of this invention.

What is claimed is:

1. A slide hammer comprising:

a guide sleeve having a distal end and a proximal end, said guide sleeve further having an inner surface defining a longitudinal passageway therein, and a distal stop positioned at said distal end;

an impact head slidably secured within said longitudinal passageway at said distal end of said guide sleeve, said impact head having a proximal end which remains within said longitudinal passageway, and a distal end including an impact extension which extends beyond said distal end of said guide sleeve, said impact head being movable between an extended position and a retracted position, the extended position being limited by said distal stop of said guide sleeve;

a plunger inserted through said proximal end of said guide sleeve and into said longitudinal passageway, said plunger having a proximal end which extends proximally beyond said proximal end of said guide sleeve, said plunger being slidable within said longitudinal passageway for selective contact with said proximal end of said impact head;

said proximal end of said impact head includes a slide portion which is positioned in close contact with said inner surface, and is freely slidable between the extended and retracted positions;

a proximal stop formed within said guide sleeve which limits the proximal travel of said impact head within said longitudinal passageway, and defines the limit of the retracted position; and wherein the contact between said plunger and said impact head results in a force transmitted to a targeted object in contact with said distal end of said impact head.

2. A slide hammer, as claimed in claim 1, further including:

a tip member removably attached to said impact extension.

3. A slide hammer, as claimed in claim 1, wherein:

said distal stop includes a washer attached to said distal end of said guide sleeve, said washer having an opening allowing said impact extension to extend therethrough.

4. A slide hammer, as claimed in claim 1, wherein:

said plunger includes a handle at said proximal end thereof for gripping and controlling the movement of said plunger within said guide sleeve opening.

5. A slide hammer, as claimed in claim 1, wherein:

said slide portion is of a first diameter, and said impact extension is of a second smaller diameter.

6. A slide hammer comprising:

a guide sleeve having a distal end and a proximal end, said guide sleeve further having an inner surface defining a longitudinal passageway therein, and a stop positioned at said distal end;

an impact head slidably secured within said longitudinal passageway at said distal end of said guide sleeve, said impact head having a proximal end which remains within said longitudinal passageway, and a distal end including an impact extension which extends beyond said distal end of said guide sleeve, said impact head being movable between an extended position and a retracted position;

a plunger inserted through said proximal end of said guide sleeve and into said longitudinal passageway, said plunger having a proximal end which extends proximally beyond said proximal end of said guide sleeve, said plunger being slidable within said longitudinal passageway for selective contact with said proximal end of said impact head;

wherein the contact between said plunger and said impact head results in a force transmitted to a targeted object in contact with said distal end of said impact head; and a weight removably attached to said proximal end of said plunger.

7. A slide hammer, as claimed in claim 1, further including:

a collar surrounding said guide sleeve;

a handle; and a connecting member interconnecting said collar and said handle for securing said handle to said guide sleeve.

8. A slide hammer comprising:

a guide sleeve having a distal end and a proximal end, said guide sleeve further having an inner surface defining a longitudinal passageway therein, and a stop positioned at said distal end;

an impact head slidably secured within said longitudinal passageway at said distal end of said guide sleeve, said impact head having a proximal end which remains within said longitudinal passageway, and a distal end including an impact extension which extends beyond said distal end of said guide sleeve, said impact head being movable between an extended position and a retracted position;

a plunger inserted through said proximal end of said guide sleeve and into said longitudinal passageway, said plunger having a proximal end which extends proximally beyond said proximal end of said guide sleeve, said plunger being slidable within said longitudinal passageway for selective contact with said proximal end of said impact head;

wherein the contact between said plunger and said impact head results in a force transmitted to a targeted object in contact with said distal end of said impact head; and means for supporting said slide hammer in an inclined position so that said proximal end of said guide sleeve is maintained at a higher elevation than said distal end, thus allowing said slide hammer to more easily transmit a force to an object on the ground.

9. A slide hammer comprising:

a plunger;

means for slidably receiving said plunger and having proximal and distal ends;

means for transferring force from said plunger to an object exterior of said means for slidably receiving, said means for transferring being freely slidable within said means for slidably receiving between an extended and a retracted position, said means for transferring being impacted by said plunger as it is slid through said means for receiving resulting in said means for transferring being moved from said retracted position to said extended positions;

said means for transferring includes a slide portion positioned within said distal end of means for receiving; and said means for receiving further includes a distal stop formed at said distal end of said means for receiving, and a proximal stop spaced from said distal end, said proximal and distal stops defining the limits of said retracted and extended positions, respectively.

10. A slide hammer, as claimed in claim 9, further including:

a removable tip attached to said means for transferring force.

11. A slide hammer, as claimed in claim 9, wherein:

said plunger includes a handle for gripping.

12. A slide hammer, as claimed in claim 9, wherein:

said means for transferring force further includes an impact extension extending beyond said distal end of said means for slidably receiving for contacting a targeted object.

13. A slide hammer, as claimed in claim 11, wherein:

said distal stop includes a washer attached to said distal end of said means for receiving, said washer further including an opening formed therethrough for allowing said means for transferring force to extend therethrough.

14. A slide hammer, as claimed in claim 12, wherein:

said slide portion of said means for transferring force has a first diameter, and said impact extension of said means for transferring force has a second smaller diameter.

15. A slide hammer, as claimed in claim 9, further including:

a weight removably attached to said proximal end of said plunger.

16. A slide hammer, as claimed in claim 9, further including:

a collar surrounding said means for slidably receiving;

a handle; and a connecting member interconnecting said collar and said handle for securing said handle to said guide sleeve.

17. A slide hammer, as claimed in claim 9, further including:

means for supporting said slide hammer in an inclined position so that a proximal end of said means for slidably receiving is maintained at a higher elevation than a distal end of said means for slidably receiving, thus allowing said slide hammer to more easily transmit a force to an object on the ground.

* * * * *